US006378888B1

(12) United States Patent
Laurent

(10) Patent No.: US 6,378,888 B1
(45) Date of Patent: Apr. 30, 2002

(54) TRAILER ASSEMBLY

(76) Inventor: Dennis R. Laurent, 1572 S. 7th Ave., Kankakee, IL (US) 60901

( * ) Notice: Subject to any disclaimer, the term of this patent is extended or adjusted under 35 U.S.C. 154(b) by 0 days.

(21) Appl. No.: 09/754,874

(22) Filed: Jan. 5, 2001

(51) Int. Cl.[7] ..... B65F 3/26
(52) U.S. Cl. ..... 280/477; 280/466; 414/482
(58) Field of Search ..... 280/477, 462, 280/466; 414/482, 483

(56) References Cited

U.S. PATENT DOCUMENTS

| | | | | | |
|---|---|---|---|---|---|
| 2,296,851 | A | | 9/1942 | Henry | |
| 3,260,547 | A | * | 7/1966 | Heilig et al. | 414/482 |
| 3,777,327 | A | | 12/1973 | Ellis | |
| 3,993,141 | A | | 11/1976 | Donohue | |
| 4,438,619 | A | | 3/1984 | Heim et al. | |
| 4,482,019 | A | | 11/1984 | Murphy | |
| 4,550,465 | A | | 11/1985 | Chrisley | |
| 4,593,426 | A | | 6/1986 | Chrisley | |
| 4,630,430 | A | | 12/1986 | Weeks | |
| 4,674,942 | A | * | 6/1987 | Assh et al. | 280/477 |
| 4,968,096 | A | * | 11/1990 | Chattin | 414/482 |
| 4,981,013 | A | | 1/1991 | Underwood | |
| D321,889 | S | | 11/1991 | Burns et al. | |
| 5,069,507 | A | * | 12/1991 | Lindsey | 414/482 |
| 5,133,413 | A | | 7/1992 | Baxter | |
| 5,151,005 | A | * | 9/1992 | Spigner | 280/462 |
| 5,218,737 | A | | 6/1993 | Dansby et al. | |
| 5,411,284 | A | * | 5/1995 | Harbin | 414/483 |
| 5,544,944 | A | * | 8/1996 | Keech | 414/483 |
| 5,871,330 | A | * | 2/1999 | Davenport | 414/482 |
| 6,142,496 | A | * | 11/2000 | Bartel | 280/124.166 |

* cited by examiner

*Primary Examiner*—Brian L. Johnson
*Assistant Examiner*—Matthew Luby

(57) ABSTRACT

A trailer assembly for collecting litter. The trailer assembly includes a carrying member for collecting litter, a support frame for supporting said carrying member and a pair of wheels for making the trailer assembly mobile. The carrying member includes a top portion that has least one aperture for allowing litter to be placed in the carrying member. The support frame includes a main support portion. A distal end of the main support portion is pivotally coupled to a lower medial portion of the carrying member. The carrying member further has a rear portion. The rear portion is pivotally coupled to a rear top end of the top portion. A lower end of the rear portion extends away from a lower back portion of the carrying member when the carrying member is pivoted relative to the main support portion of said support frame. Thus any litter in the carrying member is forced out when the carrying member is pivoted relative to the main support portion of the support frame.

20 Claims, 4 Drawing Sheets

TRAILER ASSEMBLY

BACKGROUND OF THE INVENTION

1. Field of the Invention

The present invention relates to trailers and more particularly pertains to a new trailer assembly for collecting litter.

2. Description of the Prior Art

The use of trailers is known in the prior art. More specifically, trailers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,133,413; U.S. Pat. No. 4,482,019; U.S. Pat. No. Des. 321,889; U.S. Pat. No. 2,296,851; U.S. Pat. No. 5,218,737; and U.S. Pat. No. 3,993,141, U.S. Pat. No. 4,593,426; U.S. Pat. No. 3,777,327; U.S. Pat. No. 4,550,465; U.S. Pat. No. 4,438,619; U.S. Pat. No. 4,630,430; and U.S. Pat. No. 4,981,013.

While these devices fulfill their respective, particular objectives and requirements, the aforementioned patents do not disclose a new trailer assembly. The inventive device includes a carrying member for collecting litter, a support frame for supporting said carrying member and a pair of wheels for making the trailer assembly mobile. The carrying member includes a top portion that has least one aperture for allowing litter to be placed in the carrying member. The support frame includes a main support portion. A distal end of the main support portion is pivotally coupled to a lower medial portion of the carrying member. The carrying member further has a rear portion. The rear portion is pivotally coupled to a rear top end of the top portion. A lower end of the rear portion extends away from a lower back portion of the carrying member when the carrying member is pivoted relative to the main support portion of said support frame. Thus any litter in the carrying member is forced out when the carrying member is pivoted relative to the main support portion of the support frame.

In these respects, the trailer assembly according to the present invention substantially departs from the conventional concepts and designs of the prior art, and in so doing provides an apparatus primarily developed for the purpose of collecting litter.

SUMMARY OF THE INVENTION

In view of the foregoing disadvantages inherent in the known types of trailers now present in the prior art, the present invention provides a new trailer assembly construction wherein the same can be utilized for collecting litter.

The general purpose of the present invention, which will be described subsequently in greater detail, is to provide a new trailer assembly apparatus and method which has many of the advantages of the trailers mentioned heretofore and many novel features that result in a new trailer assembly which is not anticipated, rendered obvious, suggested, or even implied by any of the prior art trailers, either alone or in any combination thereof.

To attain this, the present invention generally comprises a carrying member for collecting litter, a support frame for supporting said carrying member and a pair of wheels for making the trailer assembly mobile. The carrying member includes a top portion that has least one aperture for allowing litter to be placed in the carrying member. The support frame includes a main support portion. A distal end of the main support portion is pivotally coupled to a lower medial portion of the carrying member. The carrying member further has a rear portion. The rear portion is pivotally coupled to a rear top end of the top portion. A lower end of the rear portion extends away from a lower back portion of the carrying member when the carrying member is pivoted relative to the main support portion of said support frame. Thus any litter in the carrying member is forced out when the carrying member is pivoted relative to the main support portion of the support frame.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new trailer assembly apparatus and method which has many of the advantages of the trailers mentioned heretofore and many novel features that result in a new trailer assembly which is not anticipated, rendered obvious, suggested, or even implied by any of the prior art trailers, either alone or in any combination thereof.

It is another object of the present invention to provide a new trailer assembly that may be easily and efficiently manufactured and marketed.

It is a further object of the present invention to provide a new trailer assembly that is of a durable and reliable construction.

An even further object of the present invention is to provide a new trailer assembly which is susceptible of a low cost of manufacture with regard to both materials and labor, and which accordingly is then susceptible of low prices of sale to the consuming public, thereby making such trailer assembly economically available to the buying public.

Still yet another object of the present invention is to provide a new trailer assembly which provides in the apparatuses and methods of the prior art some of the advantages thereof, while simultaneously overcoming some of the disadvantages normally associated therewith.

Still another object of the present invention is to provide a new trailer assembly for collecting litter.

Yet another object of the present invention is to provide a new trailer assembly which includes a carrying member for collecting litter, a support frame for supporting said carrying member and a pair of wheels for making the trailer assembly mobile. The carrying member includes a top portion that has least one aperture for allowing litter to be placed in the carrying member. The support frame includes a main support portion. A distal end of the main support portion is pivotally coupled to a lower medial portion of the carrying member. The carrying member further has a rear portion. The rear portion is pivotally coupled to a rear top end of the top portion. A lower end of the rear portion extends away from a lower back portion of the carrying member when the carrying member is pivoted relative to the main support portion of said support frame. Thus any litter in the carrying member is forced out when the carrying member is pivoted relative to the main support portion of the support frame.

Still yet another object of the present invention is to provide a new trailer assembly that easy to use.

Even still another object of the present invention is to provide a new trailer assembly that encourages clean up and recycling operations.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
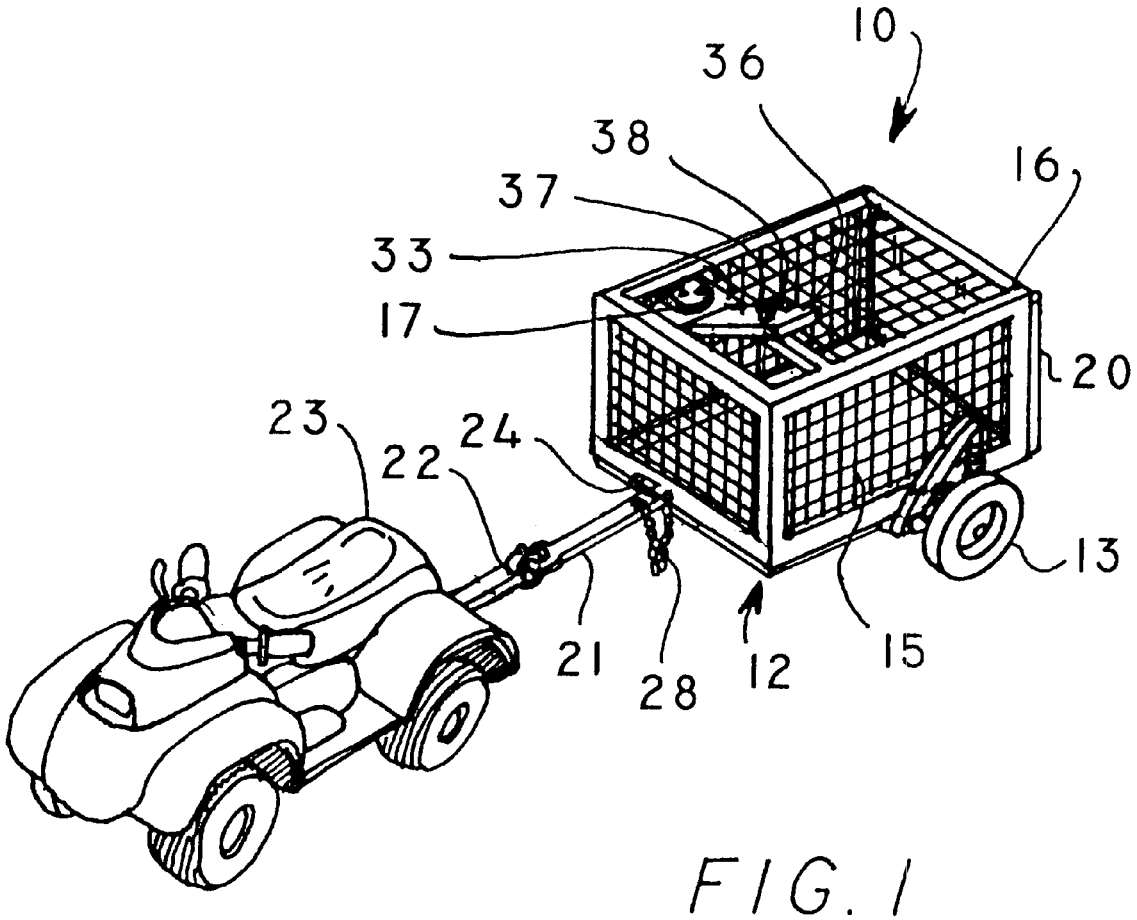
FIG. 1 is a schematic perspective view of a new trailer assembly according to the present invention.
Figure 2:
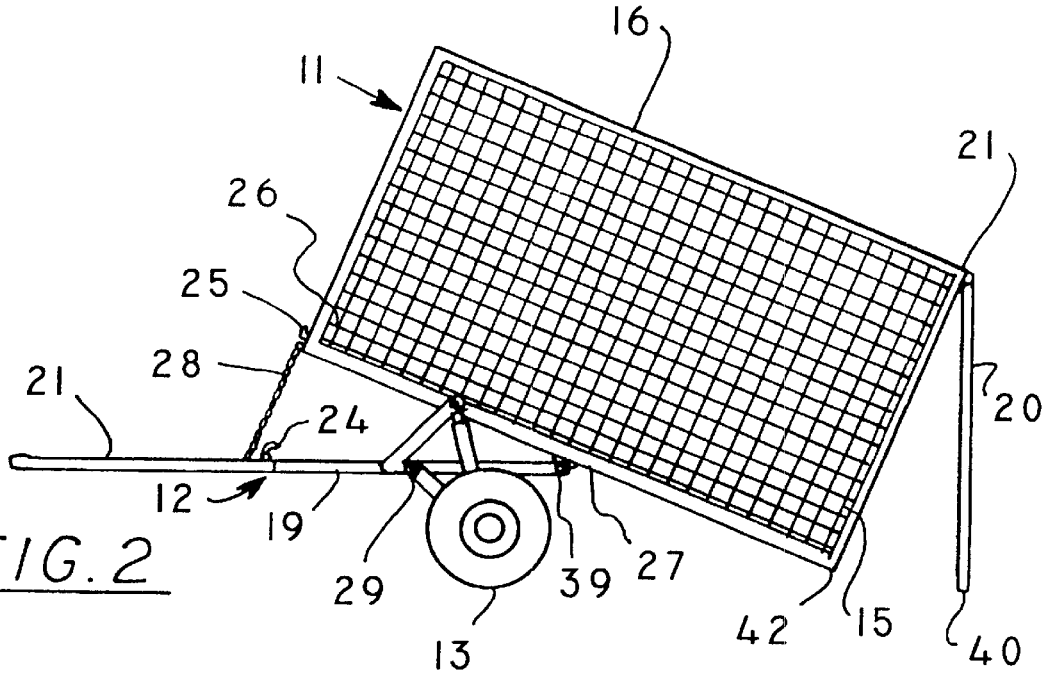
FIG. 2 is a schematic side view of the present invention, illustrating how the carrying member is pivoted relative to the frame support.
Figure 3:
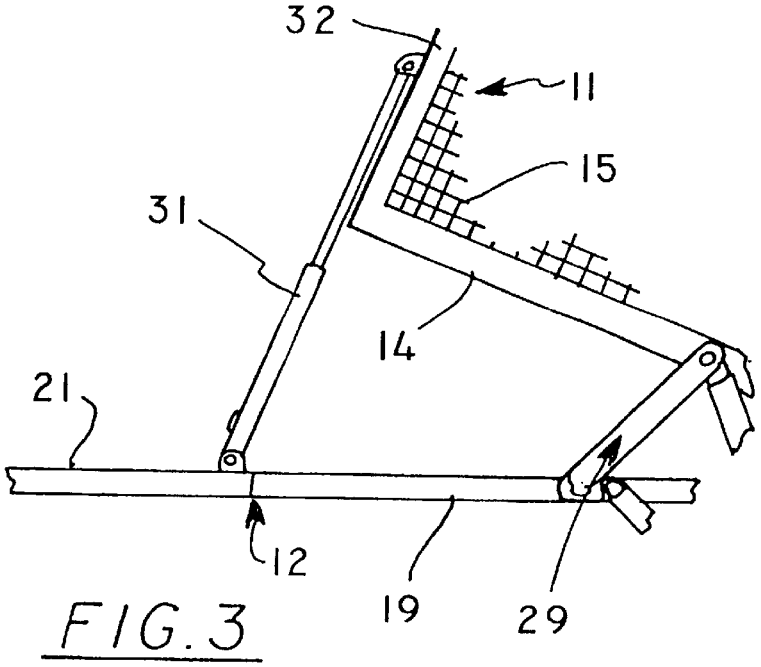
FIG. 3 is a schematic side view of the present invention, illustrating the use of an air cylinder.
Figure 4:
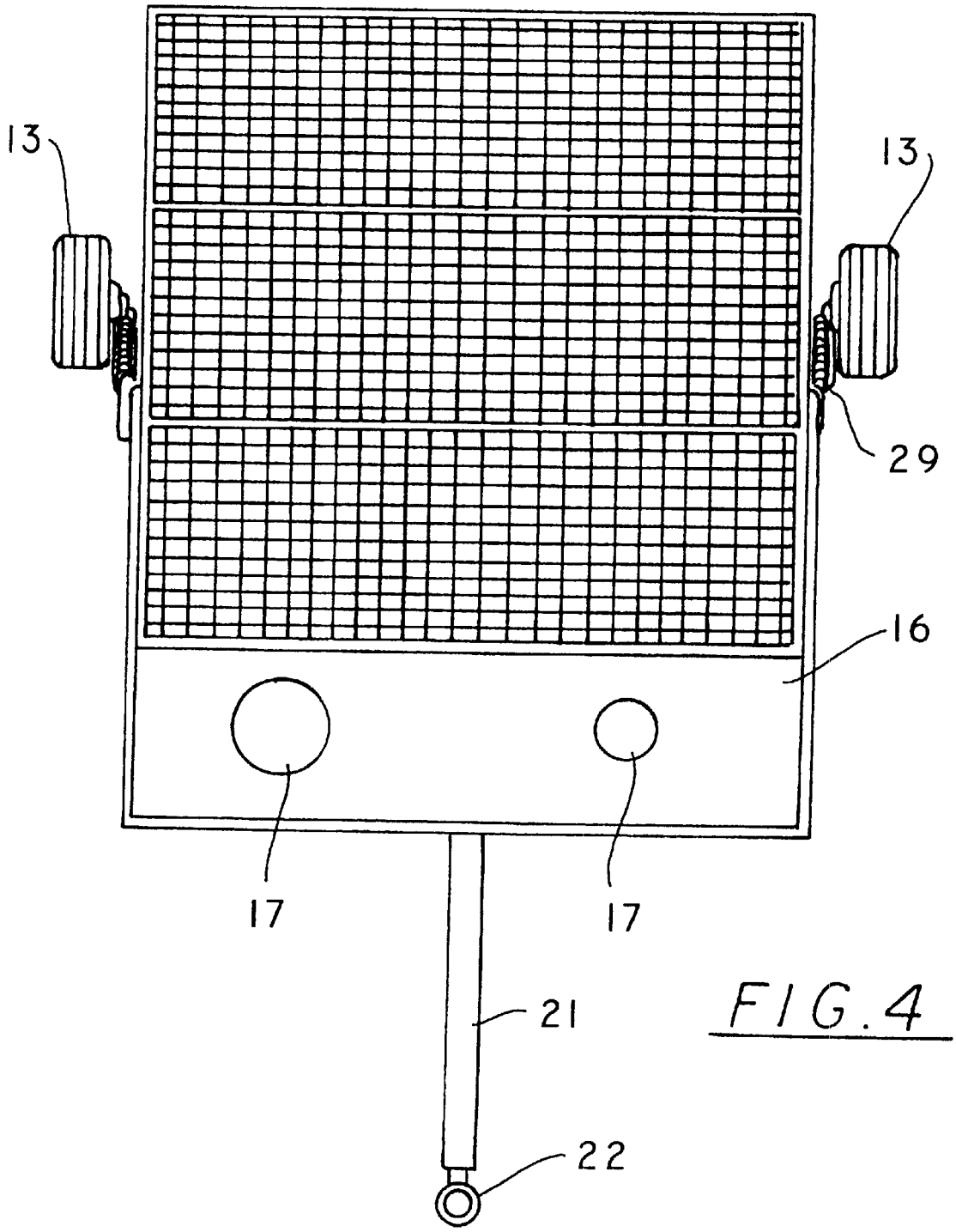
FIG. 4 is a schematic top view of the present invention.

With reference now to the drawings, and in particular to FIGS. 1 through 6 thereof, a new trailer assembly embodying the principles and concepts of the present invention and generally designated by the reference numeral 10 will be described.

As best illustrated in FIGS. 1 through 6, the trailer assembly 10 generally comprises a carrying member 11 that is pivotally coupled to a support frame 12 that has a pair of wheels 13.

In closer detail, the carrying member 11 is generally rectangular box shaped. The carrying member 11 is designed for collecting litter. The carrying member 11 includes a carrying frame 14 and a plurality of hardware cloth 15. The hardware cloth 15 covers the carrying frame 14 to form the generally rectangular box shape of the carrying member 11.

The carrying member 11 also has a top portion 16. The top portion has at least one aperture 17 for allowing litter to be placed inside the carrying member 11. In addition, the carrying member 11 may be partitioned into a plurality of sections 18. This allows a user to sort out different types of litter 30. In this embodiment, each section 18 has an associated aperture 17 in the top portion 16 of the carrying member 11 for allowing litter 30 to placed in a respective section 18.

The support frame 12 is designed for supporting the carrying member 11. The support frame 12 includes a main support portion 19. A lower medial portion 27 of the carrying member 11 is pivotally coupled to a distal end 39 of the main support portion 19.

The carrying member 11 further has a rear portion 20. The rear portion 20 is pivotally coupled to a rear top end 21 of the top portion 16. When the carrying member 12 is pivoted relative to the main support portion 19, a lower end 40 of the rear portion 20 extends away from a lower back portion 42 of the carrying member 11 thereby allowing any litter in the carrying member 11 to fall out.

The support frame 12 further includes an elongated hitch portion 21. The hitch portion 21 extends from the main support portion 19 of said support frame 12. The hitch portion 21 has a distal end 22. The distal end 21 of the hitch portion 21 is designed to selectively engage a vehicle 23 or animal 41 for towing. In an embodiment for pulling by a draft animal, the hitch portion may comprise a pair of elongated members 66 adapted for coupling to the animal 41. Each of the elongated members 66 extending from an associated side of the carrying member. A seat portion 78 may extend between the elongated members 66.

A latch member 24 is used to prevent the carrying member 11 from pivoting relative to the main support portion 19 of the support frame 12. The latch member 24 is coupled to the hitch portion 21 of the support frame 12 adjacent the main support portion 19. Moreover, the latch member 24 is selectably engaged to a receiving latch portion 25. The receiving latch portion 25 is coupled to a front lower portion 26 of the carrying member 11. Thus, when the latch member 24 is engaged to the front lower portion 26 of the carrying member 11, the carrying member 11 is prevented from pivoting relative to the support frame 12.

A chain 28 is used to limit the distance upon which the carrying member 11 may pivot relative to the main support portion 19 of the support frame 12. The chain 28 is of a predetermined length that allows the carrying member 11 to pivot far enough relative to the support frame 12 so the litter 30 in the carrying member 11 falls out. The chain 28 is coupled between the front lower portion 26 of the carrying member 11 and the hitch portion 21 of the support frame 12 adjacent the main support portion 19.

In an embodiment design to aid the user in pivoting the carrying member 11 with relation to the main support portion 19 of the frame support 12, an air cylinder 31 is used. The air cylinder 31 replaces the chain 28 and is coupled between a front medial portion 32 of the carrying member 11 and the hitch portion 21 of the support frame 12 adjacent the main support portion 19.

The wheels 13 allow the support frame 12 to be mobile. A pair of trailer arm/shock spring assemblies 29 are used to provide stability to the support frame 12 and carrying member 11 when the wheels 13 are rolled over uneven surfaces. The trailer arm/shock springs assemblies 29 couple the wheels 13 to the main support portion 19 of the support frame 12.

Moreover, a can crusher 33 for crushing aluminum cans may be coupled to the carrying member 11. The can crusher 33 has a first portion 34 that is coupled to the top portion 16 of the carrying member 11. The first portion 34 has a first surface 35 for supporting an aluminum can placed thereon. The can crusher 33 has a second portion 36. The second portion 36 has a second surface 37 designed to crush an aluminum can against the first surface 35 of the first portion 34. The second portion 36 is hingably coupled to the first portion 34. The second portion 36 is also designed to selectably cover an aperture 17 in the top portion 16 of the carrying member 11 when the second surface 37 of the second portion 36 is not crushing aluminum cans. A handle 38 is used to hingably rotate the second portion 36 in relation to the first portion 34. The handle 38 is coupled to the second surface 37 of the second portion 36.

Figure 5:
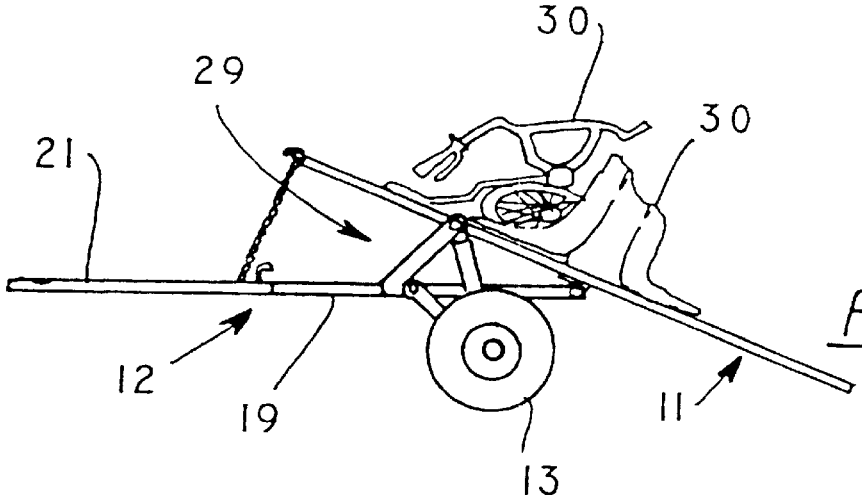
FIG. 5 is a schematic side view of the present invention, illustrating the carrying member being shaped flat.
Figure 6:
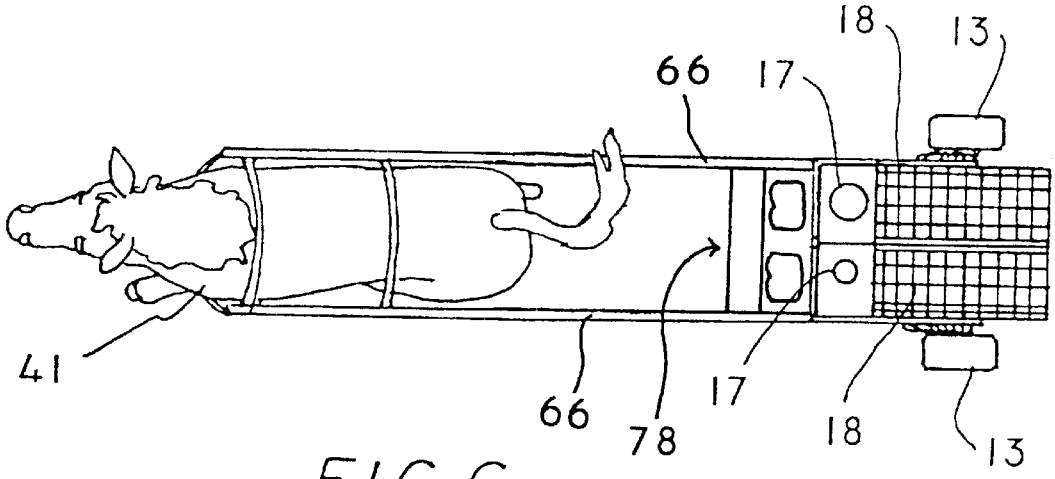
FIG. 6 is a schematic top view of an alternate embodiment of the present invention suited for being pulled by an animal.

In addition, in an embodiment designed to carry large items of litter 30, the carrying member 12 may be generally flat in shape as illustrated in FIG. 5.

In use, the distal end 22 of the hitch portion 21 of the trailer assembly 10 is engaged to a vehicle 23 or animal 41 for towing. As the trailer assembly 10 is being pulled along, pieces of litter 30 are picked off the ground and deposited into the carrying member 12. When done, the trailer assembly 10 is moved to a desired location to deposit the litter 30. The latch member 24 is then unengaged from the receiving latch portion 25 and the carrying member 11 is pivoted relative to the main support portion 19 of the frame support 12 until the litter 30 falls out of the carrying member 11. The latch member 24 is then re-engaged to the receiving latch portion 25 and the trailer assembly 10 is once again ready for use.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A trailer assembly for collecting litter, said trailer assembly comprising:

a carrying member for collecting litter;

said carrying member including a top portion, said top portion having at least one aperture for allowing litter to be placed in said carrying member;

a support frame for supporting said carrying member, said support frame including a main support portion, a distal end of said main support portion being pivotally coupled to a lower medial portion of said carrying member;

said carrying member further having a rear portion, said rear portion being pivotally coupled to a rear top end of said top portion, a lower end of said rear portion extending away from a lower back portion of said carrying member when said carrying member is pivoted relative to said main support portion of said support frame wherein said litter in said carrying member is forced out of said carrying member;

a pair of wheels for making said support frame mobile, said wheels being coupled to said main support portion of said support frame;

said support frame further including an elongated hitch portion for allowing said carrying member and support frame to be pulled, said hitch portion extending from said main support portion; and a can crusher for crushing aluminum cans, said can crusher being coupled to said top portion of said carrying member.

2. The trailer assembly for collecting litter of claim 1, wherein said carrying member has a generally rectangular box shape.

3. The trailer assembly for collecting litter of claim 1, said trailer assembly further comprising:

said carrying member having a carrying frame; and a plurality of hardware cloths, said hardware cloths covering said carrying frame.

4. The trailer assembly for collecting litter of claim 1, said trailer assembly further comprising:

a pair of trailer arm/shock spring assemblies for providing stability to said support frame when said wheels are rolled over uneven surfaces; and said trailer arm/shock springs assemblies coupling said wheels to said main support portion of said support frame.

5. The trailer assembly for collecting litter of claim 1, said trailer assembly further comprising:

a latch member for preventing said carrying member from being pivoted relative to said main support portion of said support frame, said latch member being coupled to said hitch portion of said support frame adjacent said main support portion of said support frame; and said latch member further being selectably engaged to a receiving latch portion, said receiving latch portion being coupled to a front lower portion of said carrying member wherein when said latch member is engaged to said receiving latch portion said carrying member is prevented from pivoting relative to said support frame.

6. The trailer assembly for collecting litter of claim 1, said trailer assembly further comprising:

a chain for limiting the distance upon which said carrying member may pivot relative to said main support portion of said support frame, said chain having a predetermined length, said chain being coupled between said front lower portion of said carrying member and said hitch portion of said support frame adjacent said main support portion.

7. The trailer assembly for collecting litter of claim 1, said trailer assembly further comprising:

an air cylinder for pivoting carrying member with relation to said main support portion of said frame support, said air cylinder being coupled between a front medial portion of said carrying member and said hitch portion of said support frame adjacent said main support portion.

8. The trailer assembly for collecting litter of claim 1, said trailer assembly further comprising:

said hitch portion having a distal end, said distal end of said hitch portion being adapted to engage a vehicle for towing.

9. The trailer assembly for collecting litter of claim 1, said trailer assembly further comprising:

said hitch portion comprising a pair of elongated members extending from said carrying member, distal ends of said hitch portion being adapted for coupling to an animal for towing said carrying member.

10. The trailer assembly for collecting litter of claim 1, wherein said can crusher further comprises:

a first portion, said first portion being coupled to said top portion of said carrying member, said first portion having a first surface for supporting an aluminum can placed thereon;

a second portion, said second portion having a second surface for crushing said aluminum can against said first surface of said first portion, said second portion being hingably coupled to said first portion, said second portion selectably covering said aperture in said top portion of said carrying member when said second surface is not crushing said aluminum cans; and a handle for hingably rotating said second portion in relation to said first portion, said handle being coupled to said second surface of said second portion.

11. A trailer assembly for collecting litter, said trailer assembly comprising:

a carrying member for collecting litter;

said carrying member including a top portion, said top portion having at least one aperture for allowing litter to be placed in said carrying member;

a support frame for supporting said carrying member, said support frame including a main support portion, a distal end of said main support portion being pivotally coupled to a lower medial portion of said carrying member;

said carrying member further having a rear portion, said rear portion being pivotally coupled to a rear top end of said top portion, a lower end of said rear portion extending away from a lower back portion of said carrying member when said carrying member is pivoted relative to said main support portion of said support frame wherein said litter in said carrying member is forced out of said carrying member;

a pair of wheels for making said support frame mobile, said wheels being coupled to said main support portion of said support frame;

said support frame further including an elongated hitch portion for allowing said carrying member and support frame to be pulled, said hitch portion extending from said main support portion;

said carrying member having a plurality of sections for containing different types of litter; and said top portion of said carrying member having a plurality of apertures, each of said apertures being associated with one of said sections in said carrying member.

12. The trailer assembly for collecting litter of claim 11, wherein said carrying member has a generally rectangular box shape.

13. The trailer assembly for collecting litter of claim 11, said trailer assembly further comprising:

said carrying member having a carrying frame; and a plurality of hardware cloths, said hardware cloths covering said carrying frame.

14. The trailer assembly for collecting litter of claim 11, said trailer assembly further comprising:

a pair of trailer arm/shock spring assemblies for providing stability to said support frame when said wheels are rolled over uneven surfaces; and said trailer arm/shock springs assemblies coupling said wheels to said main support portion of said support frame.

15. The trailer assembly for collecting litter of claim 11, said trailer assembly further comprising:

a latch member for preventing said carrying member from being pivoted relative to said main support portion of said support frame, said latch member being coupled to said hitch portion of said support frame adjacent said main support portion of said support frame; and said latch member further being selectably engaged to a receiving latch portion, said receiving latch portion being coupled to a front lower portion of said carrying member wherein when said latch member is engaged to said receiving latch portion said carrying member is prevented from pivoting relative to said support frame.

16. The trailer assembly for collecting litter of claim 11, said trailer assembly further comprising:

a chain for limiting the distance upon which said carrying member may pivot relative to said main support portion of said support frame, said chain having a predetermined length, said chain being coupled between said front lower portion of said carrying member and said hitch portion of said support frame adjacent said main support portion.

17. The trailer assembly for collecting litter of claim 11, said trailer assembly further comprising:

an air cylinder for pivoting carrying member with relation to said main support portion of said frame support, said air cylinder being coupled between a front medial portion of said carrying member and said hitch portion of said support frame adjacent said main support portion.

18. The trailer assembly for collecting litter of claim 11, said trailer assembly further comprising:

said hitch portion having a distal end, said distal end of said hitch portion being adapted to engage a vehicle for towing.

19. The trailer assembly for collecting litter of claim 11, said trailer assembly further comprising:

said hitch portion comprising a pair of elongated members extending from said carrying member, distal ends of said hitch portion being adapted for coupling to an animal for towing said carrying member.

20. A trailer assembly for collecting litter, said trailer assembly comprising:

a generally rectangular box shaped carrying member for collecting litter;

said carrying member having a carrying frame;

a plurality of hardware cloths, said hardware cloths covering said carrying frame;

said carrying member having a top portion;

said carrying member having a plurality of sections for containing different types of litter;

said top portion of said carrying member having a plurality of apertures, each of said apertures being associated with one of said sections in said carrying member;

a support frame for supporting said carrying member, said support frame including a main support portion, a distal end of said main support portion being pivotally coupled to a lower medial portion of said carrying member;

said carrying member further having a rear portion, said rear portion being pivotally coupled to a rear top end of said top portion, a lower end of said rear portion extending away from a lower back portion of said carrying member when said carrying member is pivoted relative to said main support portion of said support frame wherein said litter in said carrying member is forced out of said carrying member;

said support frame further including an elongated hitch portion, said hitch portion extending from said main support portion of said support frame, said hitch portion having a distal end, said distal end of said hitch portion being adapted to selectively engage a vehicle for towing;

a latch member for preventing said carrying member from being pivoted relative to said main support portion of said support frame, said latch member being coupled to said hitch portion of said support frame adjacent said main support portion of said support frame;

said latch member further being selectably engaged to a receiving latch portion, said receiving latch portion being coupled to a front lower portion of said carrying member wherein when said latch member is engaged to said receiving latch portion said carrying member is prevented from pivoting relative to said support frame;

a chain for limiting the distance upon which said carrying member may pivot relative to said main support portion of said support frame, said chain having a predetermined length, said chain being coupled between said front lower portion of said carrying member and said hitch portion of said support frame adjacent said main support portion;

a pair of wheels for making said support frame mobile;

a pair of trailer arm/shock spring assemblies for providing stability to said support frame when said wheels are rolled over uneven surfaces; and said trailer arm/shock springs assemblies coupling said wheels to said main support portion of said support frame.

* * * * *